US006378328B1

(12) United States Patent
Cholkeri et al.

(10) Patent No.: US 6,378,328 B1
(45) Date of Patent: Apr. 30, 2002

(54) BLOW-OFF ORIFICE TUBE

(75) Inventors: Pandu Cholkeri, Worthington; Gary Russo, Delaware; William Kramer, Powell, all of OH (US)

(73) Assignee: Ranco Incorporated, Plain City, OH (US)

( * ) Notice: Subject to any disclaimer, the term of this patent is extended or adjusted under 35 U.S.C. 154(b) by 0 days.

(21) Appl. No.: 09/556,667

(22) Filed: Apr. 24, 2000

(51) Int. Cl.[7] ..... F25B 41/06
(52) U.S. Cl. ..... 62/528
(58) Field of Search ..... 62/528, 498, 196.1, 62/197, 198, 199, 200, 210, 211, 212, 222; 138/40, 41, 42, 43; 137/505.12, 505.13, 505.14

(56) References Cited

U.S. PATENT DOCUMENTS

| | | | | | |
|---|---|---|---|---|---|
| 3,590,592 | A | * | 7/1971 | High | 62/115 |
| 3,640,086 | A | * | 2/1972 | Brody | 62/210 |
| 3,708,998 | A | * | 1/1973 | Scherer et al. | 62/210 |
| 3,732,704 | A | * | 5/1973 | Morgan | 62/202 |
| 3,744,268 | A | * | 7/1973 | Widdowson | 62/217 |
| 4,184,342 | A | * | 1/1980 | Pohl | 62/511 |
| 4,375,228 | A | * | 3/1983 | Widdowson | 138/46 |
| 4,593,881 | A | * | 6/1986 | Yoshino | 251/124 |
| 4,632,305 | A | * | 12/1986 | Fujiwara | 236/92 B |
| 4,651,535 | A | * | 3/1987 | Alsenz | 62/225 |
| 4,947,655 | A | * | 8/1990 | Shaw | 62/200 |
| 5,289,692 | A | * | 3/1994 | Campbell et al. | 62/181 |
| 5,477,701 | A | * | 12/1995 | Kenyon et al. | 62/225 |
| 5,579,654 | A | * | 12/1996 | Longsworth et al. | 62/511 |
| 5,613,518 | A | * | 3/1997 | Rakieski | 137/513.5 |
| 5,678,419 | A | * | 10/1997 | Sanada et al. | 62/205 |
| 6,092,379 | A | * | 7/2000 | Nishida et al. | 62/200 |

* cited by examiner

*Primary Examiner*—Teresa Walberg
*Assistant Examiner*—Daniel Robinson
(74) *Attorney, Agent, or Firm*—Porter, Wright, Morris & Arthur

(57) ABSTRACT

A refrigerant flow-control device is automatically operable between a normal or low-flow condition and a pressure relief or high-flow condition in response to pressure drop across the flow-control device, in one embodiment the flow-control device includes a tubular-shaped body having an inlet, an outlet, and a refrigerant passageway extending from the inlet to the outlet, a cylindrically-shaped restrictor secured within the tube and forming a second restriction, and a cylindrically-shaped collar secured within the tube and forming a poppet-valve flow passage. The collar is spaced-apart from the restrictor within the tube. A poppet is located within the tube partially between the restrictor and the collar and carries a valve element. The poppet is movable between a first position closing the poppet-valve flow passage to generally prevent refrigerant flow therethrough and a second position opening the poppet-valve flow passage to permit refrigerant flow therethrough. The poppet forms a first restriction. The first restriction has a higher resistance to refrigerant flow than the second restriction. A compression spring is located within the tube between the poppet and the restrictor and resiliently urges the valve element into the first position. With the valve element in the first position, the flow-control device is in a low flow condition as refrigerant flow is controlled by the first restriction. At a predetermined blow-off pressure, fluid pressure overcomes the spring to automatically move the valve element to the second position. With the valve element in the second position, the flow-control valve is in the high-flow condition as refrigerant flow is controlled by the second restriction. Once the pressure spike is relieved, the spring returns the valve element to the first position so that expansion device is in the normal or low-flow condition.

20 Claims, 12 Drawing Sheets

BLOW-OFF ORIFICE TUBE

BACKGROUND OF THE INVENTION

The present invention generally relates to refrigeration systems and, more particularly, to refrigeration systems having flow-control restriction or expansion devices incorporated therein.

A refrigeration system, such as a motor vehicle air conditioner, typically has a closed circuit through which a refrigerant undergoes a thermodynamic cycle. The circuit of a motor vehicle air conditioner typically includes an engine driven semi-hermetic compressor, a condenser connected in series to the compressor, a flow-control restriction or expansion device, which is typically a fixed orifice tube, connected in series to the condenser, an evaporator connected in series with the expansion device, and an accumulator located in series between the evaporator and the compressor. The compressor raises the pressure of "low-pressure" gaseous refrigerant to a pressure suitable for operation of the condenser. "High-pressure hot" gaseous refrigerant passes from the compressor to the condenser. The condenser condenses the high-pressure hot refrigerant by transferring heat from the refrigerant to the ambient environment or atmosphere located outside the motor vehicle. The expansion device causes the high-pressure liquid refrigerant exiting the condenser to experience a sudden pressure drop, causing the liquid refrigerant to cool and expand (usually a constant enthalpy process). The "low-pressure cold" liquid refrigerant passes to the evaporator where it vaporizes by absorbing heat from surrounding air and as a result cools the surrounding air. Typically, a fan or blower forces air across the evaporator and delivers "cooled" air to a passenger compartment of the motor vehicle. Low-pressure hot gaseous refrigerant exits the evaporator and returns to the compressor and the above-described thermodynamic cycle repeats as the refrigerant flows through the circuit. The accumulator collects any liquid refrigerant which exits the evaporator.

Such motor vehicle air conditioning systems can be tailored for efficient cooling at specific driving conditions such as, for example, highway driving (constant speed) or city driving (stop and go). The restriction or orifice of the expansion device is typically sized to obtain optimum refrigerant flow for the highway driving. As a result, cooling efficiency under city driving conditions is often less than desirable.

City driving conditions require frequent starts and stops. When the motor vehicle has a fast start or drive away, the compressor speed rapidly increases and can result in a spike in the head pressure of the refrigeration system. This is particularly true with refrigeration systems utilizing "high efficiency" scroll compressors. These pressure spikes can be very detrimental to the life span of various system components. These pressure spikes can also be high enough to trip a protective cut-off switch of the refrigeration system which is designed to prevent failure of system components such as refrigerant lines or fittings under high pressure. When the cut-off switch is tripped, the compressor is declutched and the refrigeration system is temporarily shut down until the compressor is reconnected. The refrigeration system can be shut down for about 8 seconds or more for each pressure spike. These undesired shut downs of the refrigeration system can dramatically effect cooling efficiency.

To reduce these pressure spikes, and the resulting shut downs of the refrigeration system, the size of the expansion device orifice is often increased to obtain a higher refrigerant flow rate. This increased refrigerant flow rate reduces the pressure spikes and system shut downs. However, the increased flow rate is less than optimum under other driving conditions and results in a drop in cooling efficiency. Accordingly, there is a need in the art for an improved refrigeration system and/or expansion device which reduces head pressure spikes to reduce system shut downs without significantly reducing overall cooling efficiency.

SUMMARY OF THE INVENTION

The present invention provides a refrigerant flow-control device operable between a normal low-flow condition and a pressure-relief high-flow condition which overcomes at least some of the above-noted problems related to the prior art. According to the present invention, the refrigerant flow-control device includes a body having an inlet and an outlet and forming a refrigerant passageway extending from the inlet to said outlet and a poppet within said body. The refrigerant passageway having a valve flow passage and first and second restrictions. The poppet is movable between a first position closing the valve flow passage to generally prevent refrigerant flow therethrough such that the first restriction controls refrigerant flow through the refrigerant passageway and a second position opening the valve flow passage to permit refrigerant flow therethrough such that the second restriction controls refrigerant flow through the refrigerant passageway. The device further includes a biasing member within the body and resiliently urging the poppet into the first position. The poppet is movable from the first position to the second position in response to fluid pressure acting on the poppet to relieve high pressure spikes.

According to another aspect of the present invention, the present invention provides a refrigeration system. The refrigeration system has a compressor, a condenser, and an evaporator connected in series, and an expansion device located between the condenser and the evaporator. The refrigeration system includes an expansion device body having an inlet and an outlet and forming a refrigerant passageway extending from the inlet to said outlet and a poppet within said body. The refrigerant passageway having a valve flow passage and first and second restrictions. The poppet is movable between a first position closing the valve flow passage to generally prevent refrigerant flow therethrough such that the first restriction controls refrigerant flow through the refrigerant passageway and a second position opening the valve flow passage to permit refrigerant flow therethrough such that the second restriction controls refrigerant flow through the refrigerant passageway. The device further includes a biasing member within the body and resiliently urging the poppet into the first position. The poppet is movable from the first position to the second position in response to fluid pressure acting on the poppet to relieve high pressure spikes.

According to yet another aspect of the present invention, the present invention provides a method of delivering refrigerant from a high pressure region to a low pressure region of a refrigeration system to expand the refrigerant as it enters the low pressure region. The method includes the step of coupling the high and low pressure regions through a body having an inlet and an outlet and forming a refrigerant passageway extending from the inlet to the outlet. The passageway has a valve flow passage and first and second restrictions. A poppet is mounted within the valve body such that the poppet is movable between a first position closing the valve flow passage to generally prevent refrigerant flow therethrough wherein the first restriction controls refrigerant flow through the refrigerant passageway and a second position opening the valve flow passage to permit refrigerant flow therethrough wherein the second restriction controls refrigerant flow through the refrigerant passageway. The poppet is biased into the first position. The poppet is automatically moved to the second position in response to a predetermined fluid pressure acting on the poppet to relieve high pressure spikes.

BRIEF DESCRIPTION OF THE SEVERAL VIEWS OF THE DRAWING

These and further features of the present invention will be apparent with reference to the following description and drawing, wherein.

DETAILED DESCRIPTION OF PREFERRED EMBODIMENTS OF THE INVENTION

Figure 1:
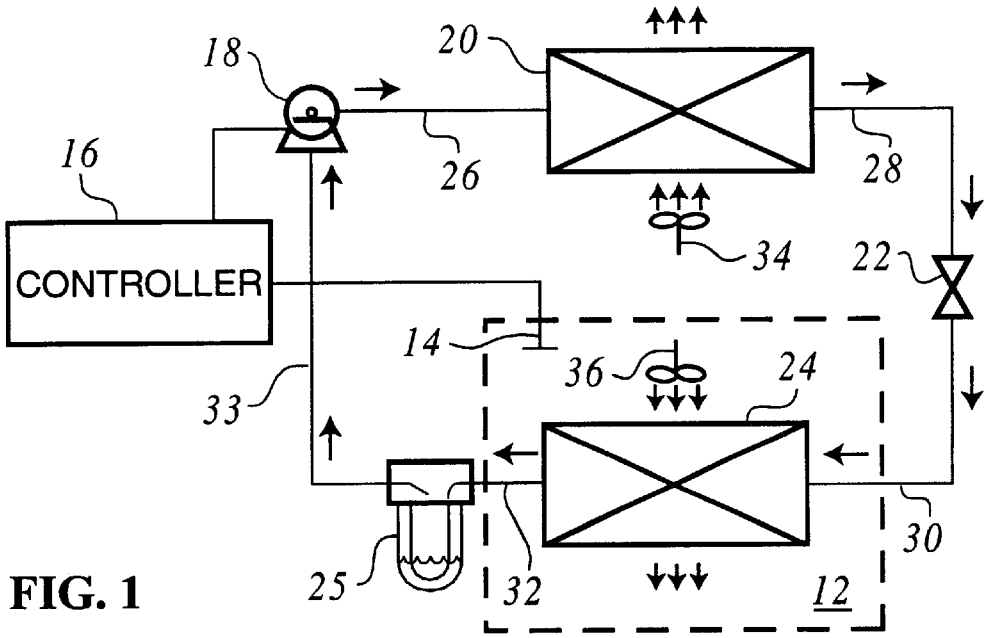
FIG. 1 is a schematic view of a refrigeration system having a refrigerant flow-control device operable between a low-flow condition and a high-flow condition according to the present invention.

FIG. 1 schematically illustrates a vapor compression refrigeration system 10 according to the present invention such as, for example, a motor vehicle air conditioner. The motor vehicle refrigeration system 10 transfers heat from air to be directed into an interior or passenger compartment 12 within the motor vehicle to ambient air or atmosphere outside the passenger compartment 12. A temperature sensor 14 can provide temperature signals to a controller 16 for controlling operation of the refrigeration system 10 to maintain the passenger compartment 12 within desired temperature limits.

The refrigeration system 10 includes a closed or sealed circuit having a compressor 18, a first heat exchanger or condenser 20 located downstream from the compressor 18, a flow-control restriction or expansion device 22 located downstream from the condenser 20, and a second heat exchanger or evaporator 24 located downstream from the expansion device 22, and an accumulator 25 located downstream from the evaporator 24 and upstream from the compressor 18. A first refrigerant line or conduit 26 connects a discharge or outlet port of the compressor 18 with an inlet port of the condenser 20. A second refrigerant line or conduit 28 connects an outlet port of the condenser 20 with an inlet or upstream end of the expansion device 22. A third refrigerant line or conduit 30 connects an outlet or downstream end of the expansion device 22 with an inlet port of the evaporator 24. A fourth refrigerant line or conduit 32 connects an outlet port of the evaporator 24 with an inlet or upstream end of the accumulator 25. A fifth refrigerant line or conduit 33 closes the circuit by connecting an outlet or downstream end of the accumulator 25 with a suction or inlet port of the compressor 18. Assembled in this manner, the compressor 18, the condenser 20, the expansion device 22, the evaporator 24, and the accumulator 25 are connected in series by the refrigerant lines 26, 28, 30, 32, 33. The refrigerant lines 26, 28, 30, 32 33 can be formed of any suitable material known in the art and can be joined in any suitable manner known in the art. It is noted that the refrigeration system 10 can have additional components within the scope of the present invention such as, for example, another evaporator connected in parallel with the evaporator 24 or another complete refrigeration system connected in series in order to cool different portions of the passenger compartment 12.

A working fluid or refrigerant such as, for example, R134A goes through a thermodynamic cycle as it flows through the closed circuit. The compressor 18 pressurizes the refrigerant and circulates the refrigerant through the circuit. Refrigerant exits the compressor 18 as a vapor at an elevated pressure. Preferably, refrigerant exits the compressor 18 at a pressure at or near an optimum pressure for operation of the condenser 20 but pressure will vary depending on the operating conditions of the motor vehicle. High-pressure refrigerant vapor passes through the first refrigerant line 26 from the compressor 18 to the condenser 20. While passing through the condenser 20, high-pressure refrigerant vapor transfers heat to a heat exchange medium such as, for example, air flowing over the condenser 20. In a motor vehicle application, heat is transferred to ambient atmosphere located outside the passenger compartment 12. Preferably, a blower or fan 34 forces air to flow over the condenser 20. This transfer of heat within the condenser 20 causes refrigerant vapor to condense to liquid. The geometry of the refrigeration system 10 is preferably such that high-pressure refrigerant liquid, substantially at compressor discharge pressure, accumulates at a downstream end of the condenser 20 when the compressor 18 is operating. The condenser 20 continues to transfer heat from accumulated refrigerant liquid so that its temperature drops below the condensation temperature corresponding to the condenser pressure. This refrigerant condition is typically referred to as "subcooled" and the extent of subcooling depends on various operating conditions of the refrigeration system 10.

High-pressure refrigerant liquid exits the condenser 20 and flows through the second refrigerant line 28 to the expansion device 22. The refrigerant effect of the refrigeration system 10 can be altered by adjusting the expansion device 22 which controls refrigerant flow to the evaporator 24. While passing through the expansion device 22, high-pressure refrigerant liquid flows through at least one restriction where it undergoes a pressure drop and may partially flash to vapor as it ideally expands and cools in a constant enthalpy process. Pressure of the refrigerant liquid is preferably reduced from at or near optimum condenser pressure at the inlet of the expansion device 22 to at or near optimum evaporator pressure at the outlet of the expansion device 22. The expansion device 22 automatically controls the flow rate of refrigerant from the condenser 20 to the evaporator 24 and automatically varies the flow rate of the refrigerant according to the pressure of the refrigerant at the inlet and the outlet of the expansion device 22. The illustrated expansion device 22 operates in either a minimum or low flow condition (best shown in FIG. 2) or a maximum or high flow condition (best shown in FIG. 3) as described in more detail hereinbelow.

Low-pressure refrigerant liquid-vapor mixture exits the expansion device 22 and flows through the third refrigerant line 30 to the evaporator 24. While passing through the evaporator 24 in a controlled manner, refrigerant is vaporized. Heat to support vaporization is absorbed from a heat exchange medium such as, for example, air flowing over the evaporator 24 so that the air is cooled. In a motor vehicle application, heat is transferred from air directed to the passenger compartment 12 so that air inside the passenger compartment 12 is cooled as desired. Preferably, a blower or fan 36 forces air across the evaporator 24 and delivers "cooled" air to the passenger compartment 12. Geometry of the refrigeration system 10 is such that low-pressure refrigerant vapor preferably accumulates at the downstream end of the evaporator 24. The evaporator 24 continues to transfer heat to the refrigerant liquid so that its temperature rises above the vaporization temperature corresponding to the evaporator pressure. This refrigerant condition is typically referred to as "superheated" and the extent of superheating depends on various operating conditions of the refrigeration system 10.

Low-pressure refrigerant vapor exits the evaporator 24 and flows through the fourth refrigerant line 32 from the evaporator 24 to the accumulator 25 and from the accumulator 25 to the compressor 18 through the fifth refrigerant line 33. In the accumulator, any refrigerant liquid which exits the evaporator 24 is trapped and remains in the accumulator 25. In the compressor 18, refrigerant pressure is again elevated and the above-described thermodynamic cycle repeats as refrigerant continues to circulate through the circuit.

Figure 2:
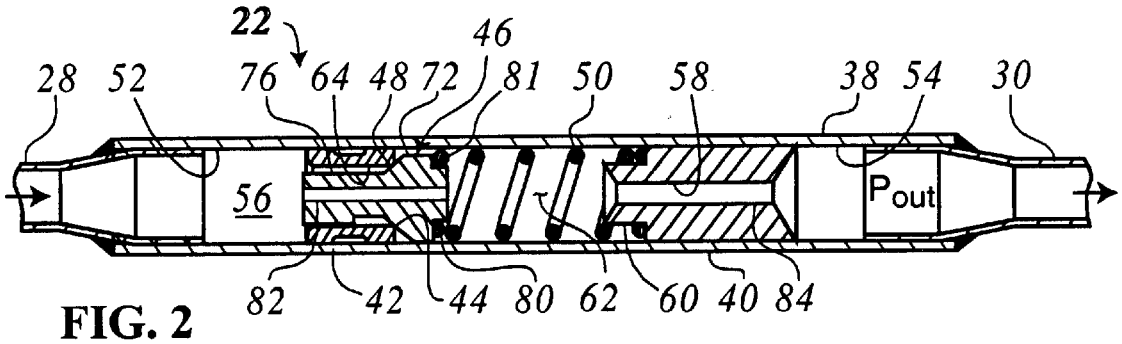
FIG. 2 is a cross-sectional view of the refrigerant-flow control device of FIG. 1 according to a first embodiment of the present invention wherein the refrigerant flow-control device is in the low-flow condition.
Figure 3:
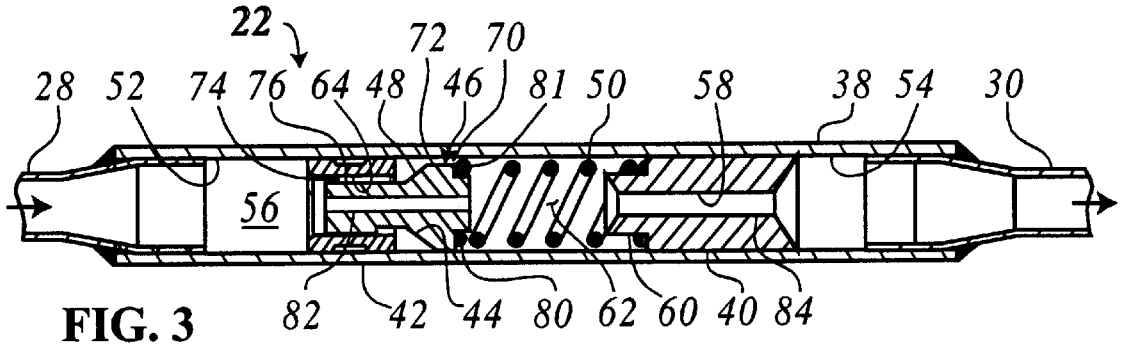
FIG. 3 is a cross-sectional view of the refrigerant flow-control device of FIG. 2 wherein the refrigerant flow-control device is in the high-flow condition.

FIGS. 2 and 3 illustrate a preferred flow-control expansion device 22 which is particularly adapted for use in a motor vehicle air conditioner according to a first embodiment the present invention. The expansion device 22 includes a body 38, a restrictor 40, a collar 42 forming a poppet valve seat 44, a poppet 46 carrying a poppet valve element 48, and a poppet biasing member 50 urging the poppet valve seat 44 and the poppet valve element 48 into engagement. The body 38 of the illustrated embodiment is a generally straight tube having a circular cross-section but it is noted that the body 38 can be in many other forms within the scope of the present invention, such as an angled tube, a machined housing, or other suitable structure. The body 38 includes a primary or inlet port 52 adapted for connection with the refrigerant line 28 which delivers refrigerant from the condenser 20 to the expansion device 22 and a secondary or outlet port 54 adapted for connection with the refrigerant line 30 which delivers refrigerant from the expansion device 22 to the evaporator 24. The refrigerant lines 28, 30 are sealingly connected to the inlet and outlet ports 52, 54 in any suitable manner. A passageway 56 extends through the body 38 and connects the inlet port 52 with the outlet port 54 for refrigerant flow therebetween. The body 38 can be formed of any suitable material known to those skilled in the art The restrictor 40 is located within the passageway 56 of the body 38 and is generally cylindrically-shaped having an outer surface sized for cooperation with the passageway 56 of the body 38. The outer surface of the restrictor 40 is preferably sized for a "tight" or "interference" fit with the body passageway 56 in a "plug-like" manner for both securing the restrictor 40 in a fixed position within the passageway 56 to prevent relative movement therebetween and sealing the outer surface of the restrictor 40 and the inner surface of the body passageway 56 to prevent refrigerant flow therebetween. It is noted that the restrictor 40 can be secured to the body 38 in additional or other manners such as by, for example, brazing, welding, crimping, mechanically or chemically fastening, or the like and can be sealed to the body 38 using, for example, sealants, seals, gaskets or the like. In the illustrated embodiment, the restrictor 40 is generally located near the outlet port 54 and downstream of the collar 42 and poppet 46. The restrictor 40 forms a first flow passage 58 which axially extends through the restrictor 40 and is generally coaxial with the passageway 56. The first flow passage provides a second orifice or restriction 84 of the expansion device 22. The second restriction 84 is sized and shaped to restrict and control refrigerant flow through the passageway 56 of the body 38 when the expansion device 22 is in the high-flow condition as described in more detail hereinbelow. The entrance and exit of the first flow passage 58 are preferably expanded such as, for example, by countersinks to improve flow into and out of the first flow passage 58. The upstream end of the restrictor 40 is preferably provided with a seat 60 for cooperating with the biasing member 50. The illustrated restrictor 40 is provided with a reduced diameter portion at its upstream end to form the seat 60 which is sized and shaped for receiving and/or supporting an end of the the poppet biasing member 50. The restrictor 40 can be formed of any suitable material known to those skilled in the art.

The collar 42 is located within the passageway 56 of the body 38 and is generally cylindrically-shaped having an outer surface sized for cooperation with the passageway 56 of the body 38. The outer surface of the collar 42 is preferably sized for a "tight" or "interference" fit with the body passageway 56 in a "plug-like" manner for both securing the collar 42 in a fixed position within the passageway 56 to prevent relative movement therebetween and sealing the outer surface of the collar 42 and the inner surface of the body passageway 56 to prevent refrigerant flow therebetween. It is noted that the collar 42 can be secured to the body 38 in additional or other manners such as by, for example, brazing, welding, crimping, mechanically or chemically fastening, or the like and can be sealed to the body 38 using, for example, sealants, seals, gaskets or the like. In the illustrated embodiment, the collar 42 is generally located near the inlet port 52 and upstream of the poppet 46 and the restrictor 40. The collar 42 is spaced apart from the restrictor 42 to form a central chamber 62 therebetween within the body passageway 56. The collar 42 forms a second flow passage or poppet-valve flow passage 64 which axially extends through the collar 42 and is generally coaxial with the body passageway 56. The poppet-valve flow passage 64 is preferably circular in cross-section and is sized and shaped to cooperate with the poppet 46 and the exit or downstream end of the poppet-valve flow passage 64 is adapted to form the poppet valve seat 44 for the poppet valve element 48 as described in more detail hereinbelow. The entrance or upstream end of the poppet-valve flow passage 64 is preferably expanded such as, for example, by countersink to improve flow into the poppet-valve flow passage 64. The collar 42 can be formed of any suitable material known to those skilled in the art.

Figure 4:
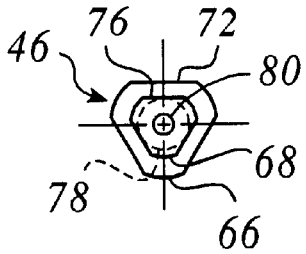
FIG. 4 is an end view of a poppet of the refrigerant flow-control device of FIGS. 2 and 3 showing the upstream end of the poppet.
Figure 5:
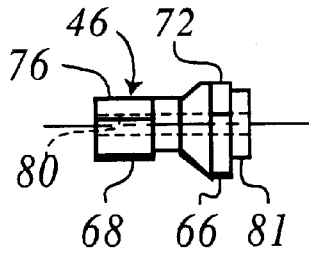
FIG. 5 is a side view of the poppet of FIG. 4.
Figure 6:
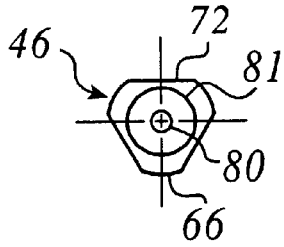
FIG. 6 is an end view of the poppet of FIGS. 4 and 5 showing the downstream end of the poppet.

The poppet 46 is located within the body passageway 56 between the restrictor 40 and the collar 42 and is adapted for axial movement within the passageway relative to the body 38, the restrictor, 40, and the collar 42. As best shown in FIGS. 4–6, the poppet 46 has a first generally cylindrically-shaped bearing surface 66 formed near its downstream end which is sized and shaped for a close fit and axial movement within the central chamber 62 of the body passageway 56 and a second generally cylindrically-shaped bearing surface 68 formed near its upstream end which is sized and shaped for a close fit and axial movement within the poppet-valve flow passage 64. The first bearing surface 66 is adapted to form an axially extending flow path 70 (FIG. 3) to permit refrigerant flow between the circumference of the poppet 46 and the inner surface of the body passageway 56 past the first bearing surface 66 when the valve element 48 is unseated. In this regard, the illustrated first bearing surface 66 is provided with at least one flat or planar section 72 which extends the full axial length of the first bearing surface 66. The illustrated embodiment is provided with three planar sections 72. It is noted that the first bearing surface 66 can be adapted to form the flow path 70 in other manners such as, for example, a plurality of flat sections or one or more flutes. The second bearing surface 68 is adapted to form an axially extending flow path 74 (FIG. 3) to permit flow between the circumference of the poppet 46 and the second flow passage 64 of the collar 42 past the second bearing surface 68 when the valve element 48 is unseated. The illustrated second bearing surface 68 is provided with at least one flat or planar section 76 oriented in alignment, that is generally parallel, with the planar section 72 of the first bearing surface 66 and extending the full axial length of the second bearing surface 66. The illustrated embodiment is provided with three planar sections 76. It is noted that the second bearing surface 68 can be adapted in other manners such as, for example, a plurality of flat sections or one or more flutes (see FIGS. 9–11).

The poppet valve element 48 is formed between the first and second bearing surfaces 66, 68 and is sized and shaped to cooperate with the poppet valve seat 44 of the collar 42 to sealingly close the valve-element flow passage 64 to prevent refrigerant flow therethrough when the valve element 48 engages the valve seat 44. The illustrated valve element 48 includes a generally frusto-conically-shaped surface sized for engaging a cooperating frusto-conically-shaped surface of the valve seat 44. The poppet 46 is preferably provided with a relief 78, that is a reduced diameter portion, located between the valve element 48 and the second bearing surface 68 for ensuring adequate seating of the valve element 48 onto the valve seat 44. It is noted that the cooperating valve seat and valve element 44, 48 can take other forms within the scope of the present invention. It is also noted that the expansion device 22 can be alternatively designed such that the poppet valve seat 44 carries by the poppet 46 and the collar 42 carries the poppet valve element 48.

The poppet 46 forms a third flow passage 80 which axially extends through the poppet 46 and is generally coaxial with the passageway 56. The third flow passage 80 forms a first orifice or restriction 82 of the expansion device 22. The first restriction 82 is sized and shaped to restrict and control refrigerant flow through the passageway 56 of the body 38 when the expansion device 22 is in the low-flow condition as described in more detail hereinbelow. The downstream end of the poppet 46 is preferably provided with a seat 81 for cooperating with the biasing member 50. The illustrated poppet 46 is provided with a reduced diameter portion at its downstream end to form the seat 81 which is sized and shaped for receiving and/or supporting the poppet biasing member 50. The poppet 46 can be formed of any suitable material known to those skilled in the art.

The illustrated poppet biasing member 50 is located within the body passageway between and engaging the restrictor 40 and the poppet 46. The poppet biasing member 50 is adapted for resiliently biasing or urging the poppet in a upstream direction toward the collar 42, that is, toward the valve seat 44, to engage the valve element 48 with the valve seat 44 and close the poppet-valve flow passage 64. The poppet biasing member 50 is preferably a helical coil compression spring but other types biasing means and/or springs can be utilized within the scope of the present invention such as, for example, tension springs, leaf springs, fluid springs, and the like. The poppet biasing member 50 is sized to seat and unseat the poppet valve element 48 at a predetermined "pop-off" or "blow-off" pressure drop across the expansion device 22. The position of the poppet 46 is controlled by refrigerant inlet and outlet pressures (Pin, Pout) at the expansion device 22. It should be appreciated that the desired pressure can be obtained by proper sizing of various design variables such as the exposed ends of the poppet 46 and the force of the poppet biasing member 50.

During operation of the refrigeration system 10, the expansion device 22 is in the low-flow condition (best shown in FIG. 2) under normal operating conditions (with the pressure drop across the expansion device relatively low), that is, when the pressure drop across the expansion device 22 is below the predetermined blow-off pressure. The expansion device 22 is in the low-flow condition at relatively low pressure drops because the poppet biasing member 50 urges the poppet 46 in an upstream direction to engage the valve element 48 against the valve seat 44 and close the poppet-valve flow passage 64. When the expansion device 22 is in this low-flow condition, refrigerant enters the expansion device 22 through the inlet port 52 and successively flows through the first restriction 82 formed by the poppet 46, the central chamber 62 located between the restrictor 40 and the collar 42, and the second restriction 84 formed by the restrictor 40 to the outlet port 54 of the expansion device 22. Refrigerant does not flow through the poppet-valve flow passage 64 because the valve element 48 of the poppet 46 is seated against the valve seat 44 to close the poppet-valve flow passage 64. While in this low-flow condition, refrigerant flow is controlled by the first restriction 82. The first restriction 82 is sized to restrict flow relative to the second restriction 84, that is, the first restriction 82 has a higher resistance to refrigerant flow than the second restriction 84. The first restriction 82 is sized as required for the particular refrigeration system 10.

When the pressure drop across the expansion device 22 rises to a relatively high level as the result of pressure spikes, that is, rises to the predetermined blow-off pressure, the expansion device 22 automatically and rapidly switches to the high-flow condition (best shown in FIG. 3). The expansion device 22 rapidly switches to the high-flow condition at relatively high pressure drops because the inlet pressure (Pin) acting on the poppet 46 overcomes the combined force of the poppet biasing member 50 and the outlet pressure (Pout) acting on the poppet 46 to move the poppet 46 in the downstream direction and disengage the valve element 48 from the valve seat 44 to open the poppet-valve flow passage 64. When the expansion device 22 is in this high-flow condition, refrigerant enters the expansion device 22 through the inlet port 52 and successively flows through the combination of the poppet-valve flow passage and first restriction 64, 82 (which are generally connected in parallel), the central chamber 62 located between the restrictor 40 and the collar 42, and the second restriction 84 formed by the restrictor 40 to the outlet port 54 of the expansion device 22. It is noted that refrigerant flows through both the poppet-valve flow passage and the first restriction 64, 82 in parallel because the valve element 48 of the poppet 46 is unseated from the valve seat 44 to open the poppet-valve flow passage 64. While in this high-flow condition, refrigerant flow through the expansion device 22 is controlled by the second restriction 84. The second restriction 84 is sized to restrict refrigerant flow relative to the combination of the poppet-valve flow passage and first restriction 64, 82, that is, the second restriction 84 has a higher resistance to refrigerant flow than the combination of the poppet-valve flow passage and first restriction 64, 82. The second restriction 84 is sized as required for the particular refrigeration system 10.

When the pressure spike is relieved and the pressure drop across the expansion device 22 returns to a relatively low level, that is, drops below the predetermined blow-of pressure to a reset pressure, the expansion device 22 automatically and rapidly switches to the low-flow condition (best shown in FIG. 2). The expansion device 22 switches to the low-flow condition at relatively low pressure drops because the inlet pressure (Pin) acting on the poppet 46 is overcome by the combined force of the poppet biasing member 50 and the outlet pressure (Pout) acting on the poppet 46 so that the poppet 46 moves in the upstream direction and engages the valve element 48 with the valve seat 44 to close the poppet-valve flow passage 64.

It is apparent from the above description that the expansion device 22 is automatically and rapidly operable between two flow conditions: (1) the low-flow condition, wherein the poppet valve element 48 is in a first or closed position so that the first restriction 82 controls refrigerant flow through the expansion device 22; and (2) the high-flow condition, wherein the poppet valve element 48 is in a second or open position so that the second restriction 84 controls refrigerant flow through the expansion device 22. It is noted that automatic and rapid operation of the expansion device 22 between these two flow conditions is controlled by the inlet and outlet pressures (Pin, Pout) of the expansion device 22 in that it is the fluid pressure at the expansion device 22 which moves the poppet 46 (along with the poppet biasing member 50). Accordingly, a solenoid or the like and its associated control system is not required to regulate the position of the poppet valve element 48 to operate the expansion device 22 between the high-flow and low-flow conditions. It is also apparent from the above description that the expansion device 22 can be designed for a desired pop-off or blow-off pressure suitable for a particular refrigeration system 10. One skilled in the art appreciates that the blow-off pressure is primarily controlled by the spring force of the biasing member 50 and the surface areas of the poppet 46 which are exposed to fluid pressure.

Figure 7:
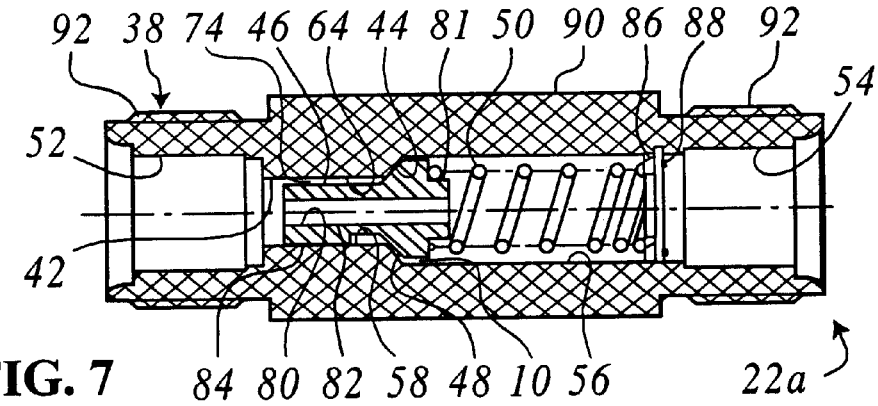
FIG. 7 is a cross-sectional view of the refrigerant-flow control device of FIG. 1 according to a second embodiment of the present invention wherein the refrigerant flow-control device is in the low-flow condition.

FIG. 7 illustrates a preferred flow-control expansion device **22*a* which is particularly adapted for use in a motor vehicle air conditioner according to a second embodiment of the present invention. The expansion device 22*a* according to the second embodiment of the present invention is substantially similar to the expansion device 22 according to the first embodiment of the invention described in detail hereinabove and like reference numbers are utilized to identify like structure. This embodiment of the expansion device 22*a* illustrates that the second restriction 84 can be advantageously formed by the flow passage 64 through the valve seat 44 rather than the flow passage 58 through the down stream restrictor 40. Forming the second restriction 84 in this manner provides a variable second restriction 84 that is dependent on the distance the poppet valve element 48 blows off of the valve seat 44. Forming the second restriction 84 in this manner also enables the restrictor 40 to be eliminated. With the restrictor 40 removed, the biasing member can be retained in any suitable manner such as the illustrated washer and snap ring 86, 88**.

This embodiment of the expansion device **22*a* also illustrates that the body 38 and collar 42 can be formed by a unitary housing 90. The housing 90 can be machined from any suitable material such as, for example, stainless steel. The housing 90 can also be provided with threaded couplings 92 for mating with connectors of the refrigerant lines 28, 30**.

Figure 8:
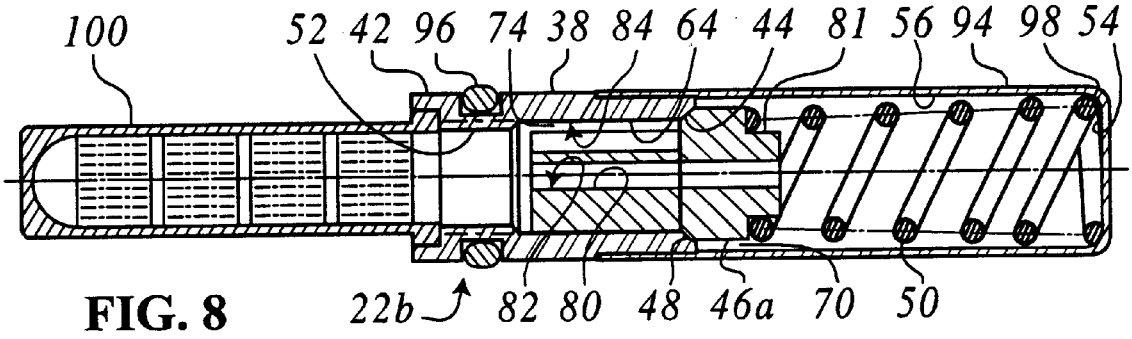
FIG. 8 is a cross-sectional view of the refrigerant-flow control device of FIG. 1 according to a third embodiment of the present invention wherein the refrigerant flow-control device is in the low-flow condition.

FIG. 8 illustrates a preferred flow-control expansion device **22*b* which is particularly adapted for use in a motor vehicle air conditioner according to a third embodiment the present invention. The expansion device 22*b* according to the third embodiment of the present invention is substantially similar to the expansion devices 22, 22*a* according to the first and second embodiments of the invention described in detail hereinabove and like reference numbers are utilized to identify like structure. This embodiment of the expansion device 22*b* illustrates that it can be formed as a direct replacement for an existing "fixed orifice tube" which is located inside the existing refrigerant line 28, 30. The expansion device 22*b* does not have a body adapted to connect the refrigerant lines as illustrated in the first and second embodiments, but has a body 38 adapted to slide into a refrigerant line 28, 30. This embodiment has the advantage of replacing existing fixed orifice tubes without modification to the refrigeration system 10**.

The body 38 includes a collar 42 and a tube member 94. The collar 42 is sized and shaped to fit within the refrigerant line 28, 30 and is provided with a seal member 96, such as the illustrated o-ring, for sealing the periphery of the collar 42 to the inner surface of the refrigerant line 28, 30 such that refrigerant flowing through the line 28, 30 must pass through the collar 42. The collar 42 can be machined from any suitable material such as, for example, stainless steel. The tube member 94 is sized and shaped to fit within the refrigerant line 28, 30 and to encircle the poppet 46 and the biasing member 50. The illustrated tube member 94 has a rolled outer end 98 to form an abutment for retaining the bias member 50 therein. The tube member can be formed of any suitable material such as, for example, stainless steel and can be secured to the collar 42 in any suitable manner such as, for example, laser welding. The forward or upstream end of the collar 42 is provided with a filter 100 in a known manner.

This embodiment of the expansion device **22*b* also illustrates that the biasing member 50 can advantageously be a conically-shaped helical spring, that is a helical spring having a larger diameter at the downstream end than at the upstream end. This configuration is believed to provide flow path from the valve seat 44 to the outlet port 54** with less resistance to flow.

Figure 9:
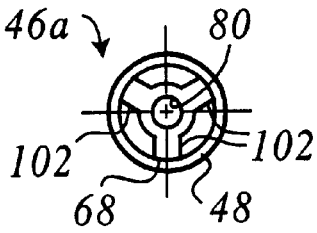
FIG. 9 is an end view of a poppet of the refrigerant flow-control device of FIG. 8 showing the upstream end of the poppet.
Figure 10:
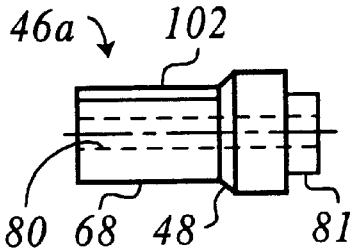
FIG. 10 is a side view of the poppet of FIG. 9.
Figure 11:
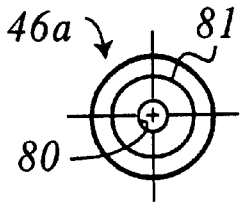
FIG. 11 is an end view of the poppet of FIGS. 9 and 10 showing the downstream end of the poppet.
Figure 12A:
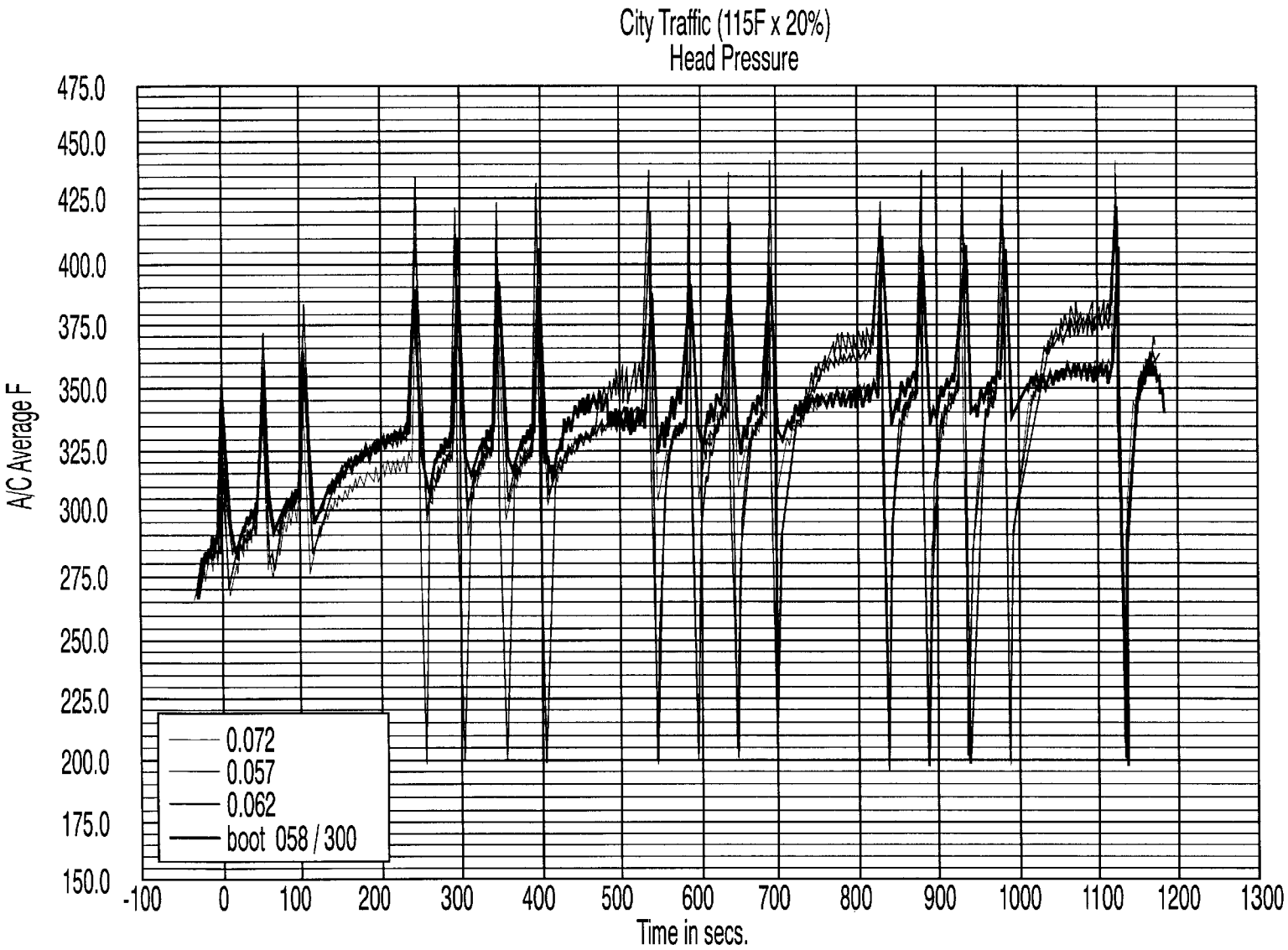
FIG. 12 is a graph showing head pressure over time for a city traffic simulation comparing various fixed orifices of the prior art and various "pop-off" or pressure-relief orifices according to the present invention.
Figure 12B:
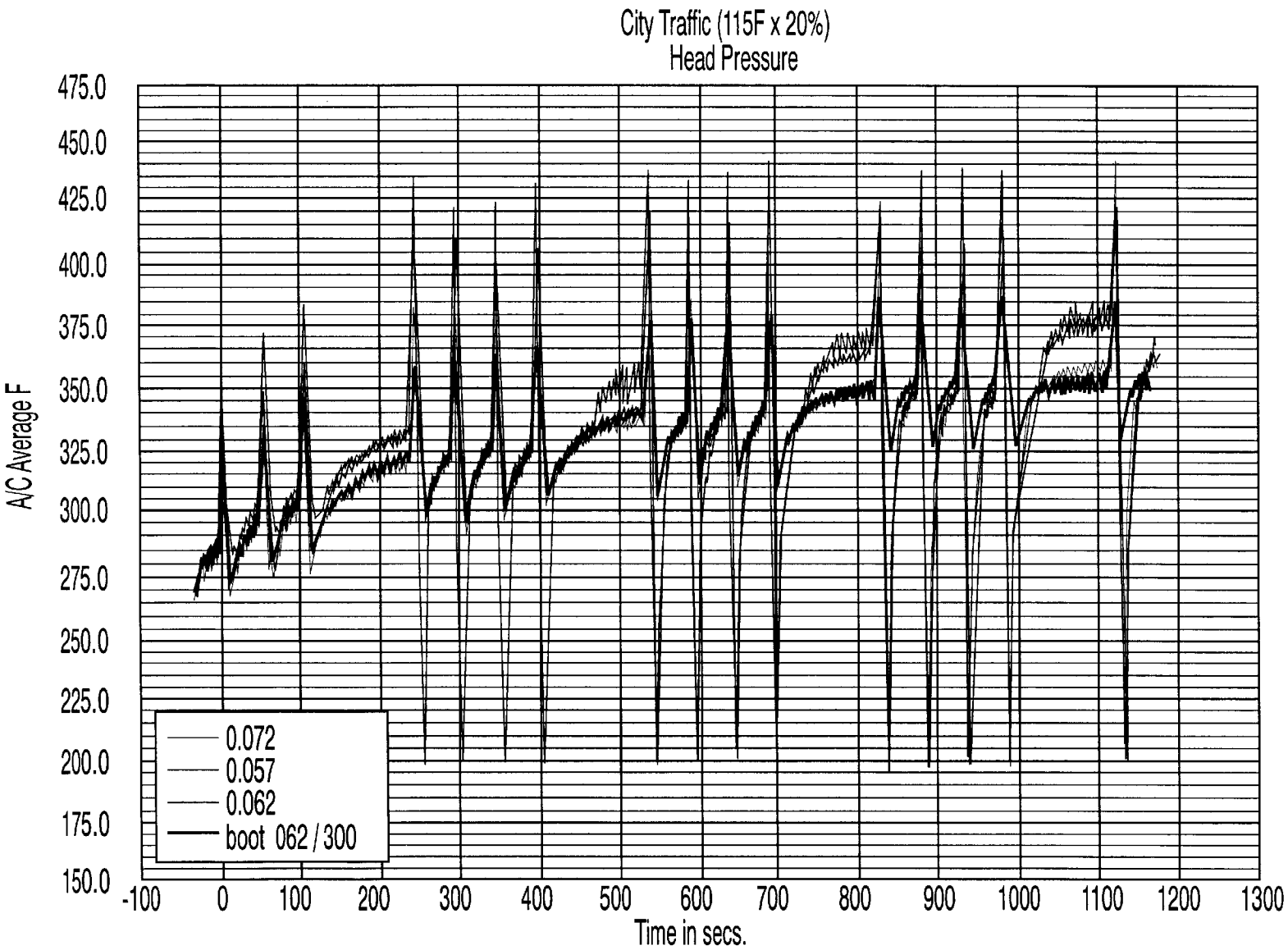
Figure 12C:
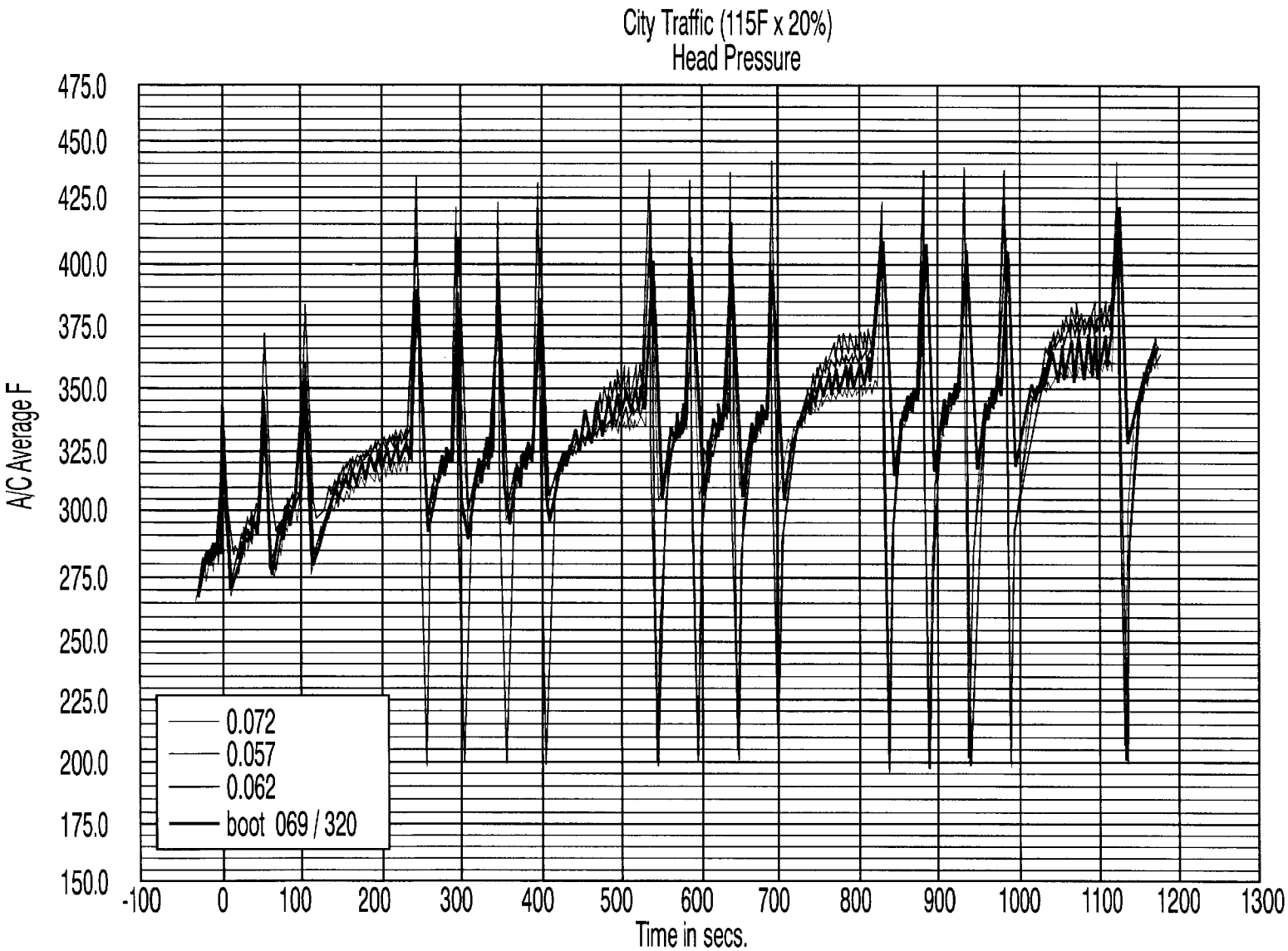
Figure 12D:
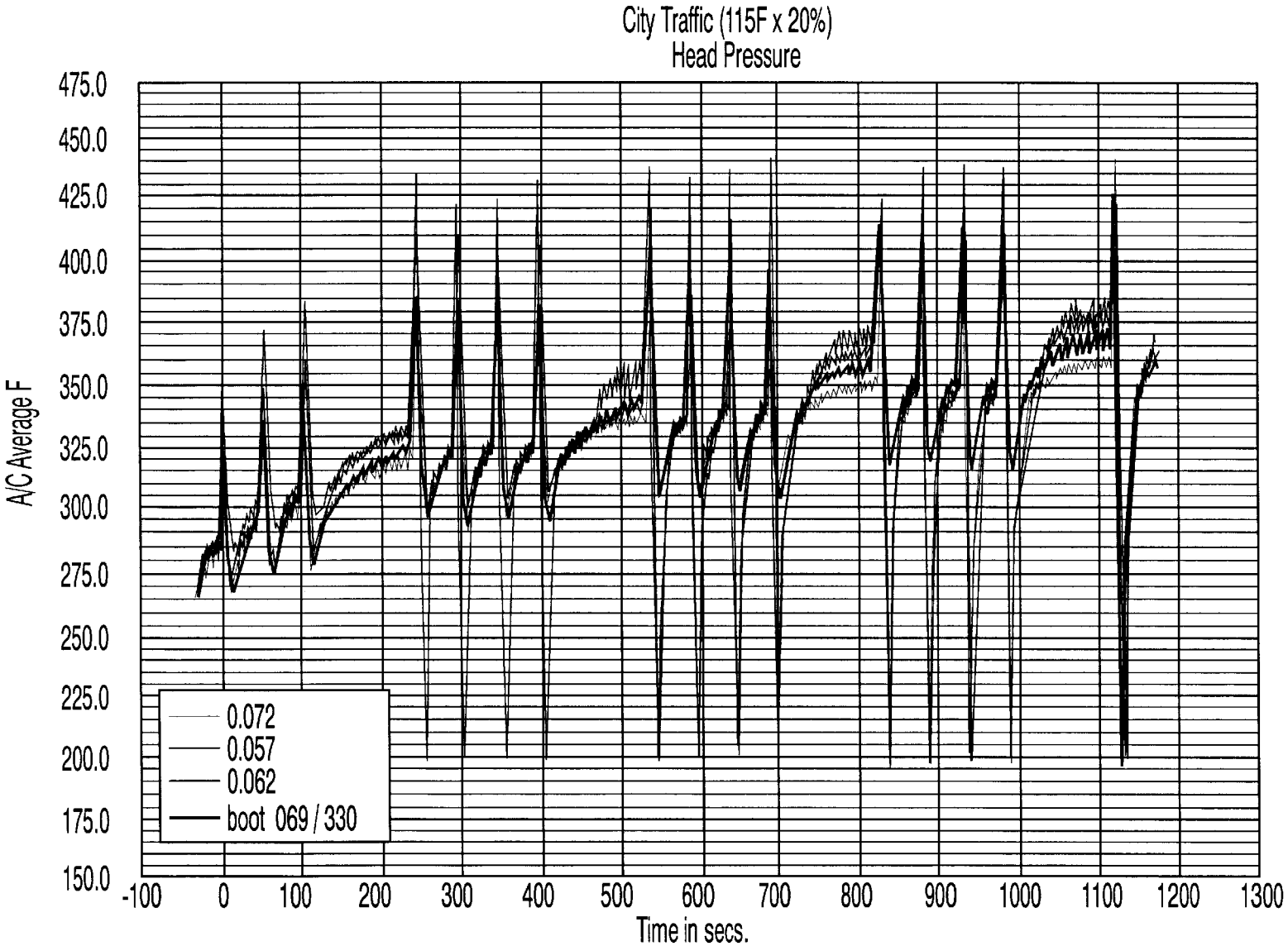
Figure 13A:
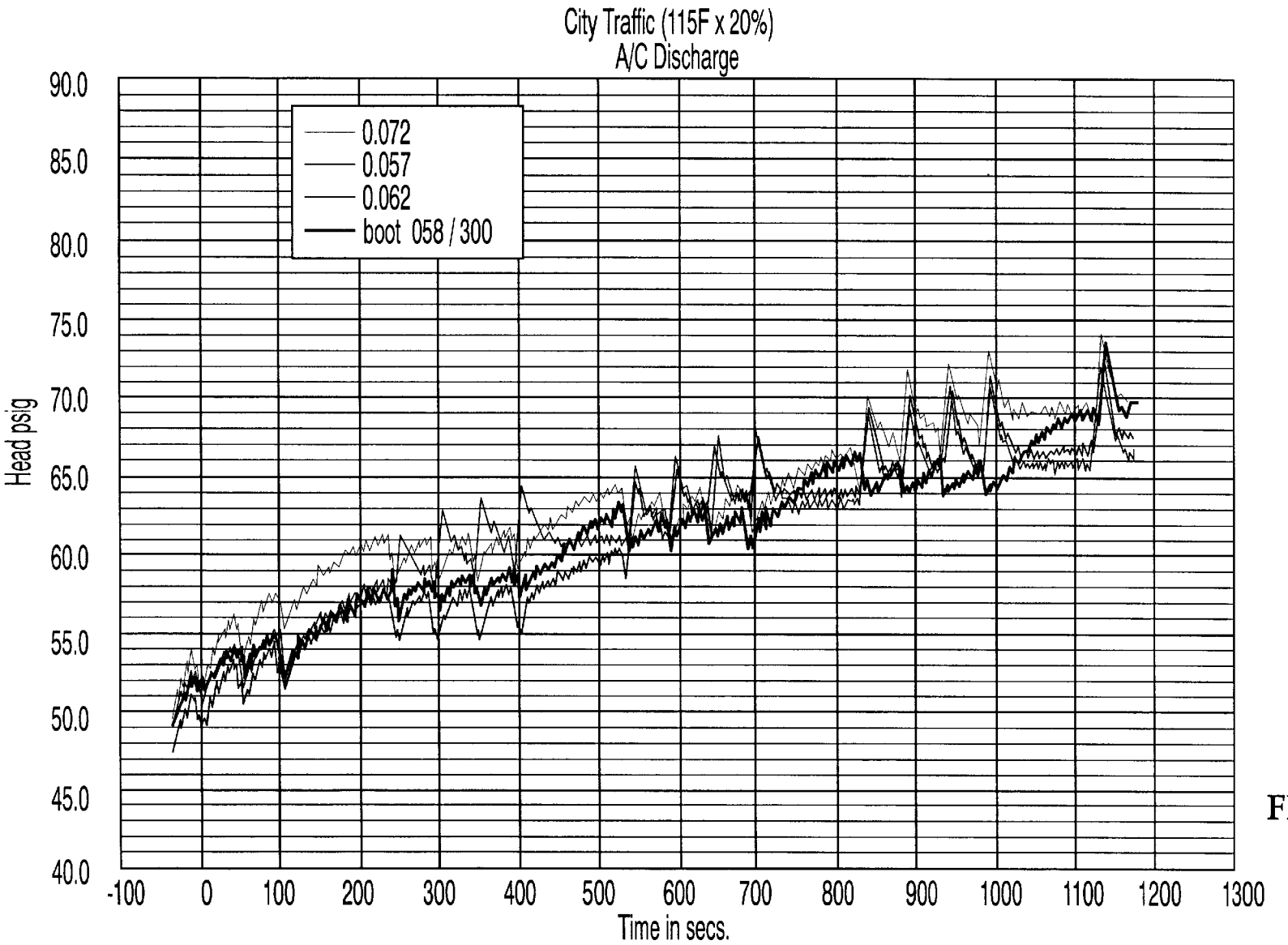
FIG. 13 is a graph showing A/C average temperature over time for the city traffic simulation of FIG. 12.
Figure 13B:
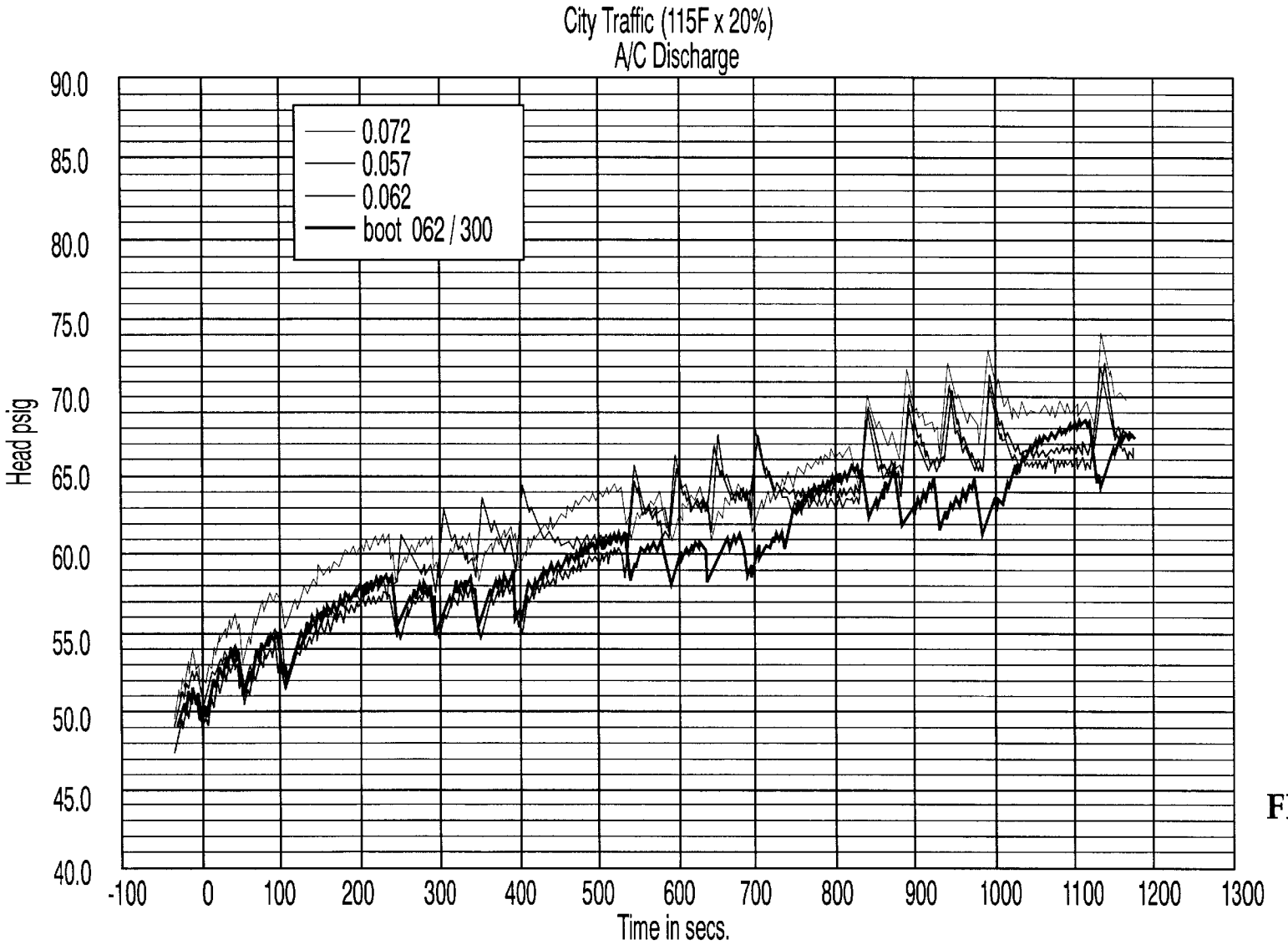
Figure 13C:
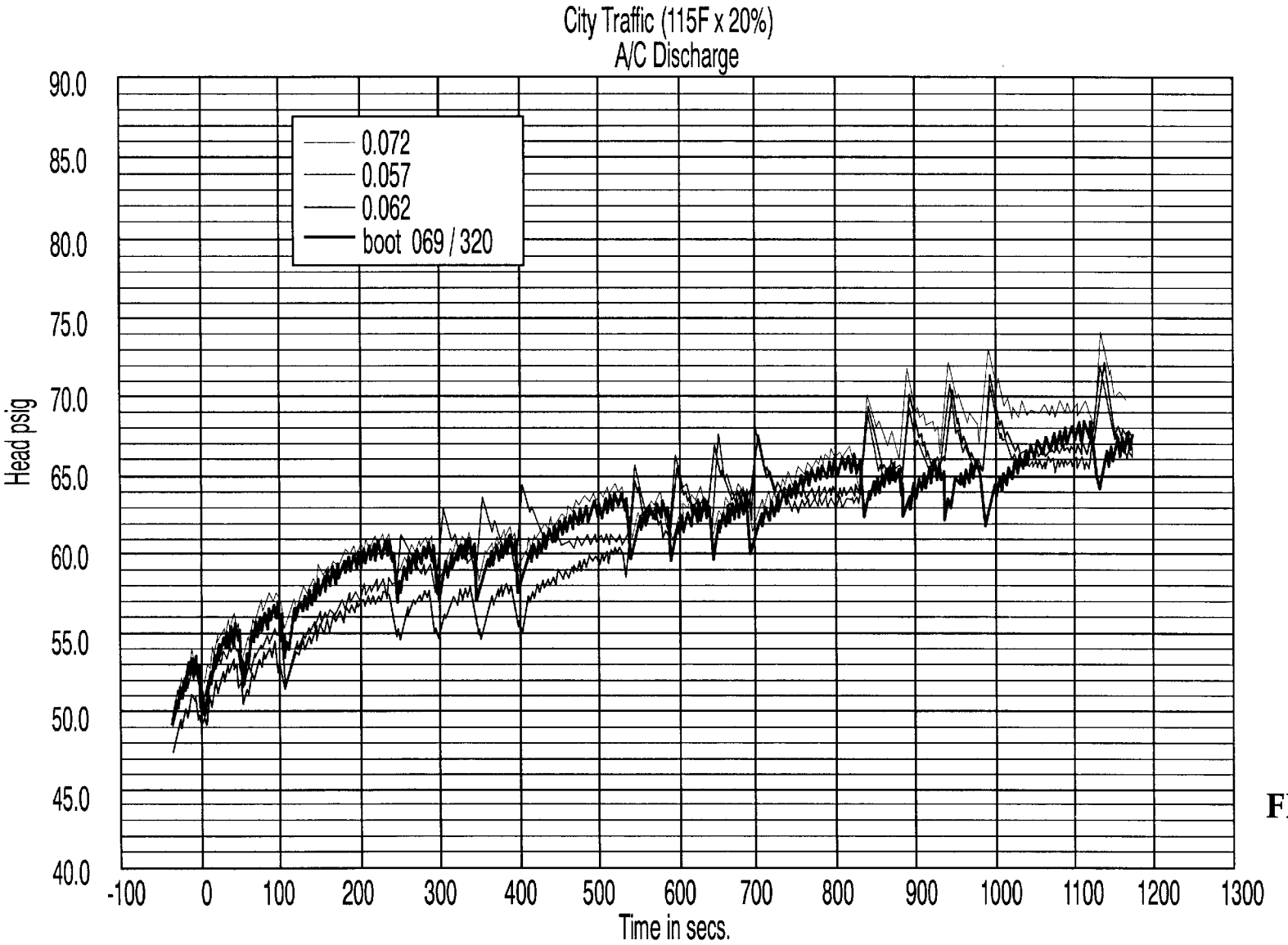
Figure 13D:
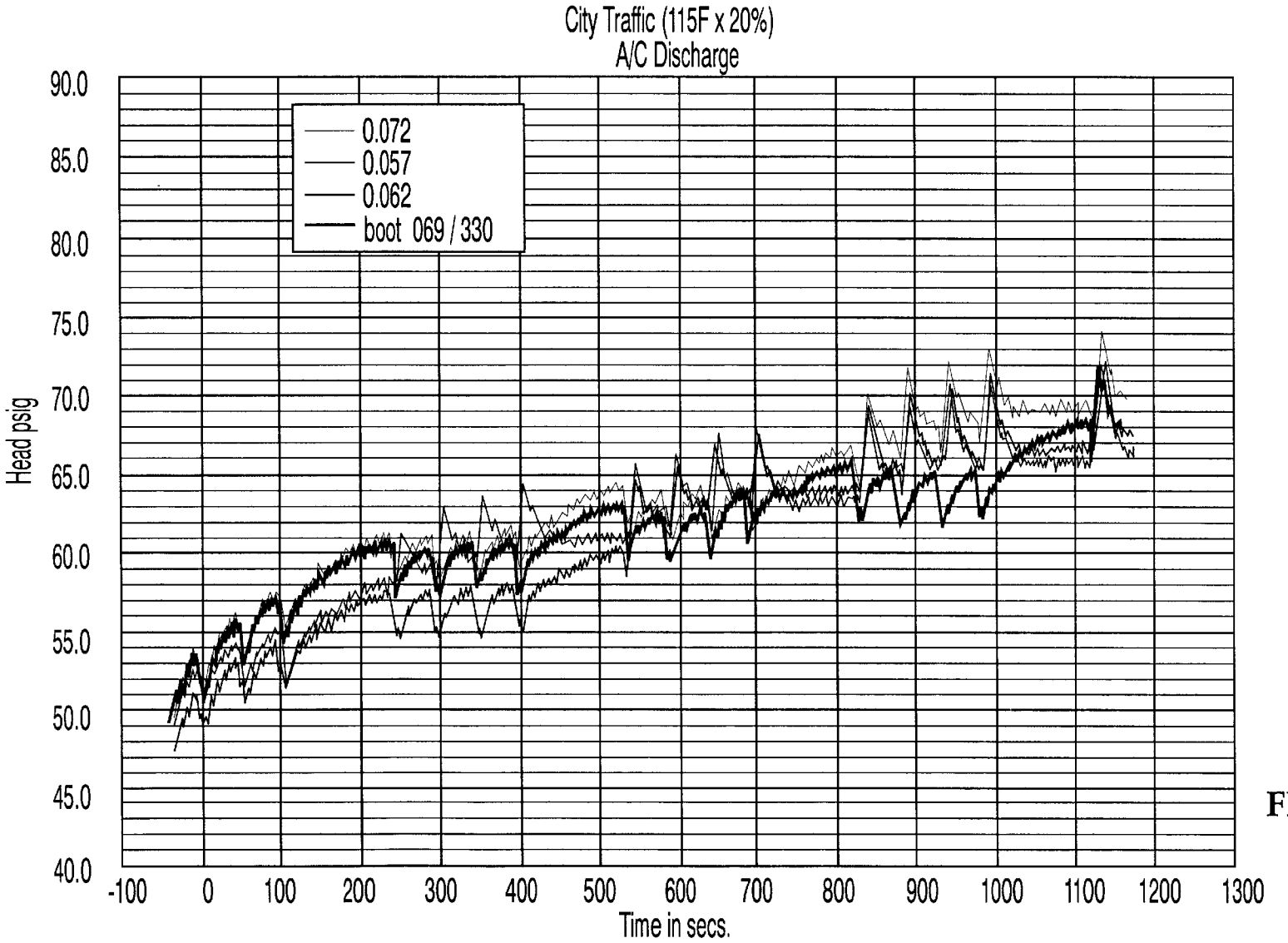

This embodiment of the expansion device 22*b* further illustrates that the poppet 46*a* can have other forms. FIGS. 9 to 11 illustrate that the second bearing surface 68 can be formed by a plurality of flutes 102. The poppet 46*a* also illustrates that the first bearing surface 66 (FIGS. 4–6) can be eliminated such that the flow passage 70 is generally annular shaped. It is noted that alternatively the first bearing surface 66 can be retained and the second bearing surface 68 eliminated. It is noted that this embodiment of the poppet 46*a* is particularly well adapted for molding from a plastic material.

It is noted that each of the features of the various embodiments of the expansion device can be utilized with any of the other embodiments.

Figure 14:
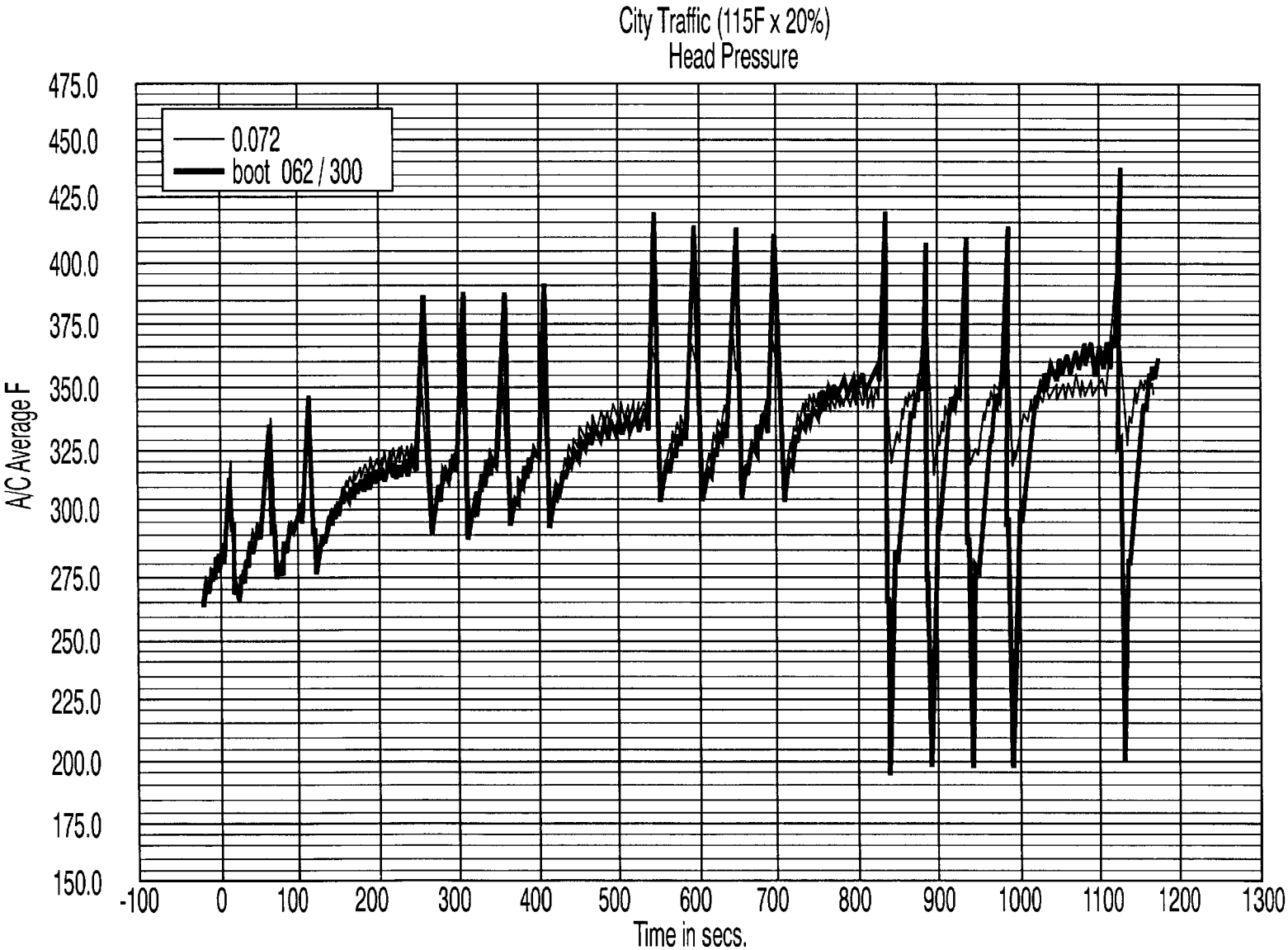
FIG. 14 is a graph similar to FIG. 12 but comparing only the best performing fixed orifice and the best performing pressure relief orifice according to the present invention.
Figure 15:
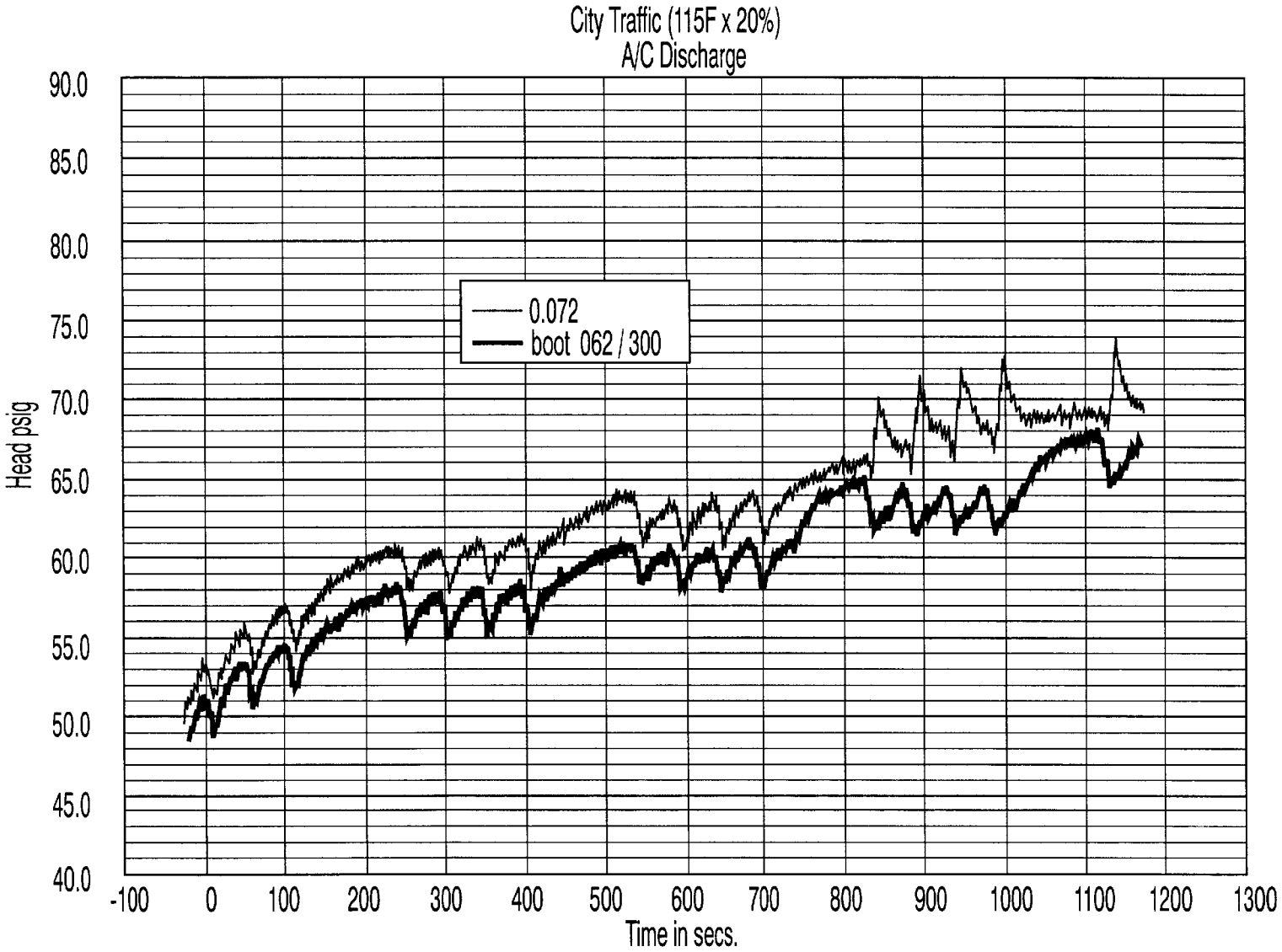
FIG. 15 is a graph similar to FIG. 13 but showing only the A/C average temperatures for the orifices of FIG. 14.

FIGS. 12 to 15 illustrate results of a motor vehicle test which simulates city driving while the air conditioning system is operating. Test conditions include an ambient temperature of 115 degrees F. and humidity of 20%. A motor vehicle was accelerated in four consecutive sets of four accelerations and then accelerated in a final drive away. The test was performed with the air conditioning system having a variety of different expansion devices: (1) a standard fixed orifice of 0.057 inches; (2) a standard fixed orifice of 0.062 inches; (3) a standard fixed orifice of 0.072 inches; (4) a blow-off orifice of 0.058 inches and having a blow-off pressure of 300 psi; (5) a blow-off orifice of 0.062 inches and having a blow-off pressure of 300 psi; (6) a blow-off orifice of 0.069 inches and having a blow-off pressure of 320 psi; and (7) a blow-off orifice of 0.069 inches and having a blow-off pressure of 330 psi. FIG. 12 illustrates head pressure of the refrigeration system while FIG. 13 illustrates the average temperature coming into the passenger compartment. It can be seen that head pressure increases with each acceleration and the temperature rises with each stop. Each of the standard fixed orifices resulted in a declutching of the compressor: the 0.057 inch orifice in the second set of accelerations; the 0.062 inch orifice in the third set of accelerations; and the 0.072 inch orifice in the fourth set of accelerations. When the compressor declutches, the head pressure spikes then drops in a wild manner. It can be seen that as the orifice size is increased there is increased flow so that the declutching is reduced but the temperature is increased. Each of the blow-off orifices reach a pressure relief state during the test but never declutch the compressor. FIGS. 14 and 15 compare the 0.072 fixed orifice and the 0.062 inch blow-off orifice. The graphs show that the blow-off orifice enables the restriction to be optimally sized for high highway conditions without having declutching of the compressor under city conditions. The result is a dramatic temperature decrease of up to about 5 degrees F. compared to the fixed orifice for city conditions. Cooling efficiency also improves under highway conditions because the orifice size can be optimized for highway conditions (without enlargement to solve the declutching problem in city conditions).

Although particular embodiments of the present invention have been described in detail, it will be understood that the present invention is not limited correspondingly in scope, but includes all changes and modifications coming within the spirit and terms of the claims.

What is claimed is:

1. A refrigerant flow-control device operable between a low-flow condition and a high-flow condition, said refrigerant flow-control device comprising:

a body having an inlet and an outlet and forming a refrigerant passageway extending from said inlet to said outlet, said passageway having a valve flow passage and first and second restrictions;

a poppet within said body and movable between a first position closing said valve flow passage to generally prevent refrigerant flow therethrough such that said first restriction controls refrigerant flow through the refrigerant passageway and a second position opening said valve flow passage to permit refrigerant flow therethrough such that said second restriction controls refrigerant flow through the refrigerant passageway;

a biasing member within said body and resiliently urging said poppet into said first position, wherein said poppet is movable from the first position to the second position in response to fluid pressure acting on said poppet to relieve high pressure spikes; and wherein the device provides a greater restriction to flow between the inlet and the outlet when the poppet is in the first position than when the poppet is in the second position.

2. A refrigerant flow-control device according to claim 1, wherein said poppet forms and carries said first restriction.

3. A refrigerant flow-control device according to claim 1, wherein said first restriction is adapted to have a higher resistance to refrigerant flow than said second restriction.

4. A refrigerant flow-control device according to claim 1, wherein said biasing member is a compression spring.

5. A refrigerant flow-control device according to claim 4, wherein said compression spring is conically shaped.

6. A refrigerant flow-control device according to claim 1, wherein said second restriction is located downstream of said first restriction.

7. A refrigerant flow-control device according to claim 1, wherein flow through said second restriction is generally parallel with flow through said first restriction.

8. A refrigerant flow-control device according to claim 1, wherein said valve flow passage is generally circular in cross-section, said poppet has a generally cylindrically-shaped bearing surface adapted to cooperate with said valve flow passage, and said bearing surface is adapted to form a flow path to permit refrigerant flow through said valve flow passage with said bearing surface therein.

9. A refrigerant flow-control device according to claim 8, wherein said flow path is formed by a generally flat surface interrupting said bearing surface.

10. A refrigerant flow-control device according to claim 8, wherein said flow path is formed by a plurality of flutes forming said bearing surface.

11. A refrigerant flow-control device according to claim 1, wherein said valve flow passage forms said second restriction.

12. A refrigerant flow-control device according to claim 1, wherein said body is a generally straight tube and said second restriction is formed by a cylindrically-shaped restrictor secured within said tube, said valve-element passage is formed by a cylindrically-shaped collar secured within said tube and spaced-apart from said restrictor, and said first restriction is formed by a poppet carrying said valve element and located within said tube at least partially between said restrictor and said collar.

13. A refrigerant flow-control device according to claim 12, wherein said biasing member is compression spring located within said tube and having one end seated against said restrictor and another end seated against said poppet.

14. A refrigerant flow-control device according to claim 1, wherein said body includes a housing forming said valve flow passage, said second restriction is formed by said valve flow passage, and said first restriction is formed and carried by said poppet.

15. A refrigerant flow-control device according to claim 14, wherein said biasing member is compression spring located within said housing and having one end seated against said poppet and another end seated against and abutment of said housing.

16. A refrigerant flow-control device according to claim 1, wherein said body includes a housing forming said valve flow passage and a tube secured to and extending from said housing, said biasing member is located at least partly within said tube, said second restriction is formed by said valve flow passage, and said first restriction is formed and carried by said poppet.

17. A refrigerant flow-control device according to claim 16, wherein said biasing member is compression spring located at least partly within said tube and having one end seated against said poppet and another end seated against a rolled end of said tube.

18. A refrigeration system having a compressor, a condenser, and an evaporator connected in series and an expansion device located between the condenser and the evaporator, said refrigeration system comprising:

an expansion valve body having an inlet and an outlet and forming a refrigerant passageway extending from said inlet to said outlet, said passageway having a valve flow passage and first and second restrictions;

a poppet within said body and movable between a first position closing said valve flow passage to generally prevent refrigerant flow therethrough such that said first restriction controls refrigerant flow through the refrigerant passageway and a second position opening said valve flow passage to permit refrigerant flow therethrough such that said second restriction controls refrigerant flow through the refrigerant passageway;

a biasing member within said body and resiliently urging said poppet into said first position, wherein said poppet is movable from the first position to the second position in response to fluid pressure acting on said poppet to relieve high pressure spikes; and wherein the device provides a greater restriction to flow between the inlet and the outlet when the poppet is in the first position than when the poppet is in the second position.

19. The refrigeration system according to claim 18, further including a refrigeration line having an inner wall and wherein said expansion valve body is located within said refrigeration line and sealingly engaging said inner wall such that refrigerant passing through said refrigerant line passes through said refrigerant passageway of said body.

20. A method of delivering refrigerant from a high pressure region to a low pressure region of a refrigeration system to expand the refrigerant as it enters the low pressure region, said method comprising the steps of:

(a) coupling the high and low pressure regions through a body having an inlet and an outlet and forming a refrigerant passageway extending from the inlet to the outlet, the passageway having a valve flow passage and first and second restrictions;

(b) mounting a poppet within the valve body such that the poppet is movable between a first position closing the valve flow passage to generally prevent refrigerant flow therethrough wherein the first restriction controls refrigerant flow through the refrigerant passageway and a second position opening the valve flow passage to permit refrigerant flow therethrough wherein the second restriction controls refrigerant flow through the refrigerant passageway;

(c) biasing the poppet into the first position;

(d) automatically decreasing the resistance to flow from the inlet to the outlet by moving the poppet to the second position in response to a predetermined fluid pressure acting on the poppet to relieve high pressure spikes; and (e) automatically returning the poppet to the first position after the high pressure spikes are relieved in response to the bias on the poppet.

* * * * *